US006371322B1

(12) United States Patent
Bryant

(10) Patent No.: US 6,371,322 B1
(45) **Date of Patent: *Apr. 16, 2002**

(54) SANITARY GO BOX HANDLING DEVICE

(76) Inventor: Paskel Bryant, 3280 Eastern Valley Rd., Leeds, AL (US) 35094

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/287,962

(22) Filed: Apr. 9, 1999

(51) Int. Cl.[7] ..... A47G 19/00

(52) U.S. Cl. ..... 220/23.86; 220/737; 220/752; 220/758; 294/32

(58) Field of Search ..... 220/556, 573.4, 220/573.5, 507, 575, 555, 212, 771, 23.83, 23.86, 772, 737, 741; 99/422; D7/550.1, 552.1, 553.1, 553.7; 219/725, 737; 206/541, 545, 562, 564; 229/904; 211/130.1; 294/32, 27.1

(56) References Cited

U.S. PATENT DOCUMENTS

| | | | | | |
|---|---|---|---|---|---|
| 113,822 | A | | 4/1871 | Walker et al. | |
| 124,730 | A | * | 3/1872 | Fahnestock | 294/169 |
| 216,346 | A | * | 6/1879 | Read | 220/771 |
| 867,086 | A | * | 9/1907 | Sullivan | 220/912 |
| 934,374 | A | * | 9/1909 | Tomberlin | 220/772 |
| D57,844 | S | * | 5/1921 | Kristofek | 220/771 |
| 1,540,792 | A | * | 6/1925 | McLaren et al. | 221/85.4 |
| 1,659,344 | A | * | 2/1928 | Wissman | 294/143 |
| 1,781,056 | A | * | 11/1930 | Elder | 220/771 X |
| 2,370,860 | A | * | 3/1945 | Hanke | 16/425 |
| 2,515,617 | A | * | 7/1950 | Tilford | 220/555 |
| 2,540,392 | A | | 2/1951 | Haskell | |
| 2,621,825 | A | * | 12/1952 | Lyon | 220/771 |
| 2,654,628 | A | * | 10/1953 | Klante | 248/145.6 X |
| 2,666,551 | A | * | 1/1954 | Wyman | 220/771 |
| 2,935,384 | A | * | 5/1960 | Schalm et al. | 206/564 X |
| 3,044,659 | A | | 7/1962 | Tupper | |
| 3,094,258 | A | | 6/1963 | Punke | |
| 3,142,425 | A | * | 7/1964 | Cobb | 294/159 |
| 3,179,780 | A | * | 4/1965 | Verstraten | 219/725 |
| 3,259,416 | A | | 7/1966 | Mannisi | |
| 3,447,728 | A | | 6/1969 | Maben | |
| 3,633,785 | A | * | 1/1972 | Cyr | 206/545 X |
| 3,704,663 | A | * | 12/1972 | Shull et al. | 99/347 |

(List continued on next page.)

FOREIGN PATENT DOCUMENTS

| | | | | |
|---|---|---|---|---|
| AT | 141902 | * | 6/1935 | 220/771 |

OTHER PUBLICATIONS

Bud's Go Bo Tool Promotional Video Transcript, Provided by Applicant, Undated.*

*Primary Examiner*—Lee Young
*Assistant Examiner*—Joseph C. Merek
(74) *Attorney, Agent, or Firm*—Robert J. Veal; Robert M. Jackson; Burr & Forman LLP

(57) ABSTRACT

A food handling apparatus utilizes a web designed to cooperate with go box, as used by commercial food establishments such as restaurants and delicatessens, and connected to a handle such that a food service worker may grasp the handle with the go box lid open and safely ladle food into the box. The handle is angled to permit the box to overlie the handle and hand, thereby ensuring no contact with the internal surfaces of the box.

11 Claims, 3 Drawing Sheets

U.S. PATENT DOCUMENTS 3,891,084 A 6/1975 Elizondo-Garcia
3,938,688 A * 2/1976 Ryan ..... 206/545 X
3,964,629 A * 6/1976 McCabe ..... 220/23.86
4,306,133 A * 12/1981 Levinson ..... 219/725
D286,009 S * 10/1986 Nadav ..... D8/373
4,642,443 A * 2/1987 Jorgensen et al. ..... 219/725
4,694,961 A 9/1987 Menendez
4,717,069 A * 1/1988 Pizzolato ..... 206/545 X
4,900,886 A * 2/1990 Bridges ..... 219/725
4,946,058 A * 8/1990 Stamm ..... 220/23.83
5,098,144 A 3/1992 Marvin
5,183,169 A 2/1993 Grzych
5,274,216 A * 12/1993 DeGrow et al. ..... 219/386
5,339,728 A 8/1994 Marchwiak et al.
5,501,338 A 3/1996 Preston
5,524,949 A 6/1996 Mooney
5,690,245 A * 11/1997 Jenkins ..... 220/23.86 X
5,722,316 A 3/1998 Rutland, Jr.
5,740,937 A * 4/1998 Sheu ..... 220/23.83
5,857,583 A * 1/1999 Chantaca et al. ..... 229/904 X

* cited by examiner

SANITARY GO BOX HANDLING DEVICE

FIELD OF THE INVENTION

The present invention relates to the food service industry and more particularly to the individual food handlers or servers who prepare what are known as "go boxes." In greater particularity the present invention relates to a tool for use by such individuals in the performance of the preparation of go boxes when food is introduced into the box.

BACKGROUND OF THE INVENTION

In common practice, millions of meals are served daily in expanded foam containers known as "go boxes." Typically, the foodstuff is placed in the box by a food handler employed by the establishment selling the food. While regulations in some instances require the use of gloves and hairnets, these regulations are not always followed or enforced. Accordingly, the handling of the food and the go box may lead to food-borne illness. In 1990, the U.S. Department of Agriculture reported an estimate of 40 to 80 million cases of food borne illness. Inasmuch as such illnesses are generally caused by bacteria, yeast, molds, viruses, and parasites which originate from soil, processing, transportation or food handling, the exact percentage of the illnesses which are directly related to food handling is not readily quantifiable.

Although not readily quantifiable, certain factors relating to food handling indicate significant risk to consumer, to wit: Up to 50 percent of the food handlers employed at any one time are carriers of disease agents which may be transmitted to consumers by improper handling of foodstuffs. For example: Salmonella may remain in a person's system for months after recovery; hepatitis A has been found in the intestinal tract up to five years after the disappearance of disease symptoms; staphylococci are found in boils, pimples, cuts, bums, eyes and nose. Contaminated hands transmit bacteria and viruses from the body to food, thus a food handler's hands are one of the most important factors in preventing the transmission of disease organisms in a food establishment.

Currently, food handlers preparing go boxes grasp the box as they ladle or spoon the food into the box. Often times the fingers of the food handler will overlap the sides of the box into the area or wells wherein the food is being place. If the food is hot the worker can be burned, but more importantly, the worker's fingers or glove may come in contact with the food being placed in the container. It is to be understood that the go boxes are made of light weight foam and are inherently flexible; thus, it is difficult to handle the box without grasping the edges. Accordingly, it is difficult to ensure that food workers do not physically touch the foods.

SUMMARY OF THE INVENTION

It will be appreciated that the forgoing concerns indicate a need for an improvement in the manner in which foodstuffs are placed in go boxes and the like. The present invention provides for a reusable implement which will allow the food service person to hold the go box securely without actually touching any inner surface of the box, thereby avoiding contamination of the food by the worker as well as reducing the opportunity for burns and spills due to the flexibility of the go box.

The invention utilizes a web designed to cooperate with the go box and connected to a handle such that the food service worker may grasp the handle with the go box lid open and safely ladle food into the box. The handle is angled to permit the box to overlie the handle and hand, thereby ensuring no contact with the internal surfaces of the box The present invention is a device for use with disposable food boxes having a plurality of wells formed therein and a cover flexibly attached along a margin for selective closure of the plurality of wells, comprising a handle suitable for gripping by a food service worker; and a web integrally formed on the handle including interconnected spaced-apart members defining openings commensurate with the shape of the wells such that a food box may rest on the web with the wells extending into the openings. The handle may include a first portion extending from the web and a second portion offset vertically beneath the first portion, and a continuous transition between the first and second portion. The interconnected spaced-apart members of the present invention may each have downwardly and inwardly sloping surfaces defining the openings. The handle and the web may be molded from a rigid plastic and the handle may extend outwardly from the web a height below the plane of the web.

The present invention may also be described as a device for use with disposable food boxes having a plurality of wells formed therein, comprising a handle, molded from a rigid plastic, suitable for gripping by a food service worker; and a web integrally formed at an end of the handle, also molded from a rigid plastic, including interconnected spaced apart members defining openings commensurate with the shape of the wells wherein the interconnected spaced-apart members each have downwardly and inwardly sloping surfaces defining the opening such that a food box may rest on the web with the wells extending into the openings, and wherein the handle includes a first portion extending from the web and a second portion offset vertically beneath the first portion, the handle including a continuous transition between the first and second portion.

The present invention may further be described as a tool for use by food service workers handling boxes having wells formed therein for serving food, comprising a web of rigid material including a plurality of spaced-apart members defining a plurality of openings corresponding to the wells in a box such that the wells may fit within the web openings; and a handle integrally formed with the web and extending outwardly therefrom at an elevation beneath the plane of the web.

BRIEF DESCRIPTION OF THE DRAWINGS

A food handling implement embodying the features of the present invention is depicted in the attached drawings which form a portion of this disclosure and wherein.

DESCRIPTION OF A PREFERRED EMBODIMENT

Figure 1:
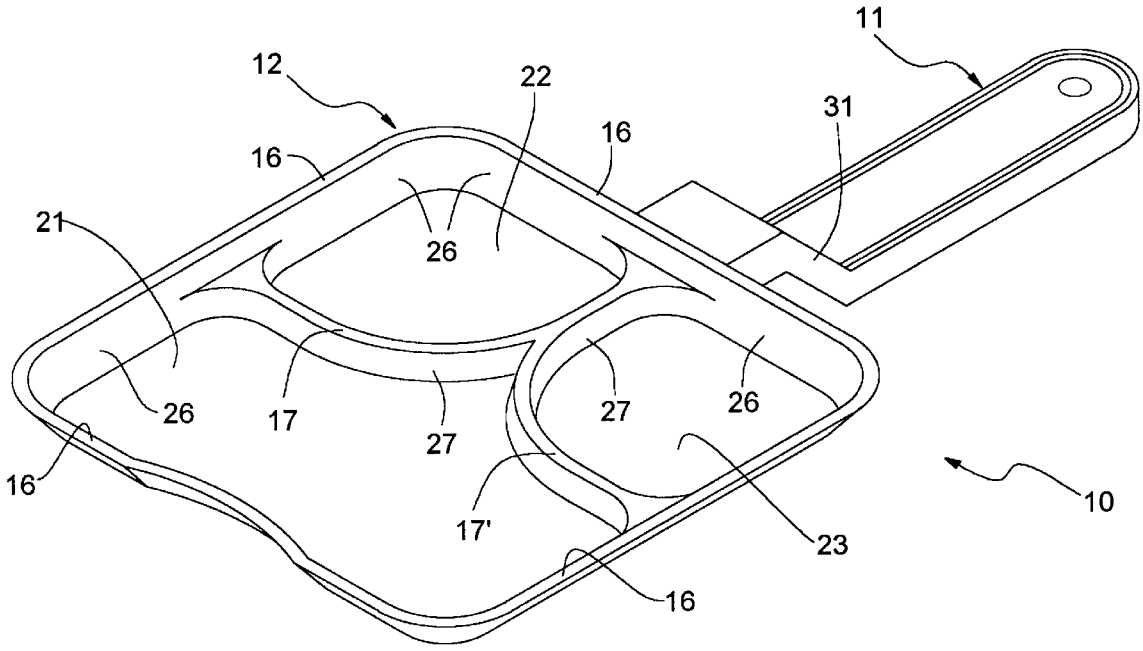
FIG. 1 is a perspective view of the implement.
Figure 2:
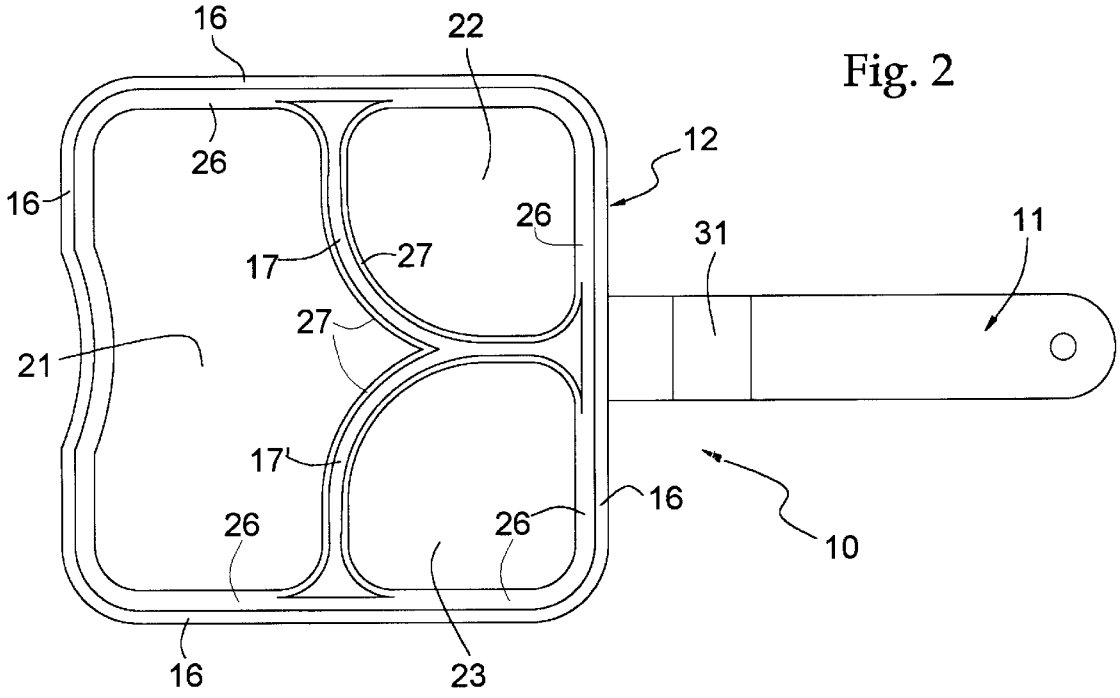
FIG. 2 is a plan view of the implement.
Figure 3:
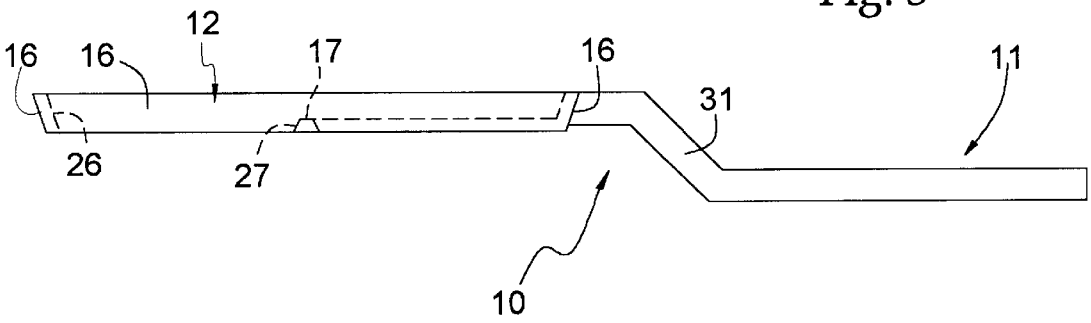
FIG. 3 is a side elevational view of the implement.
Figure 4:
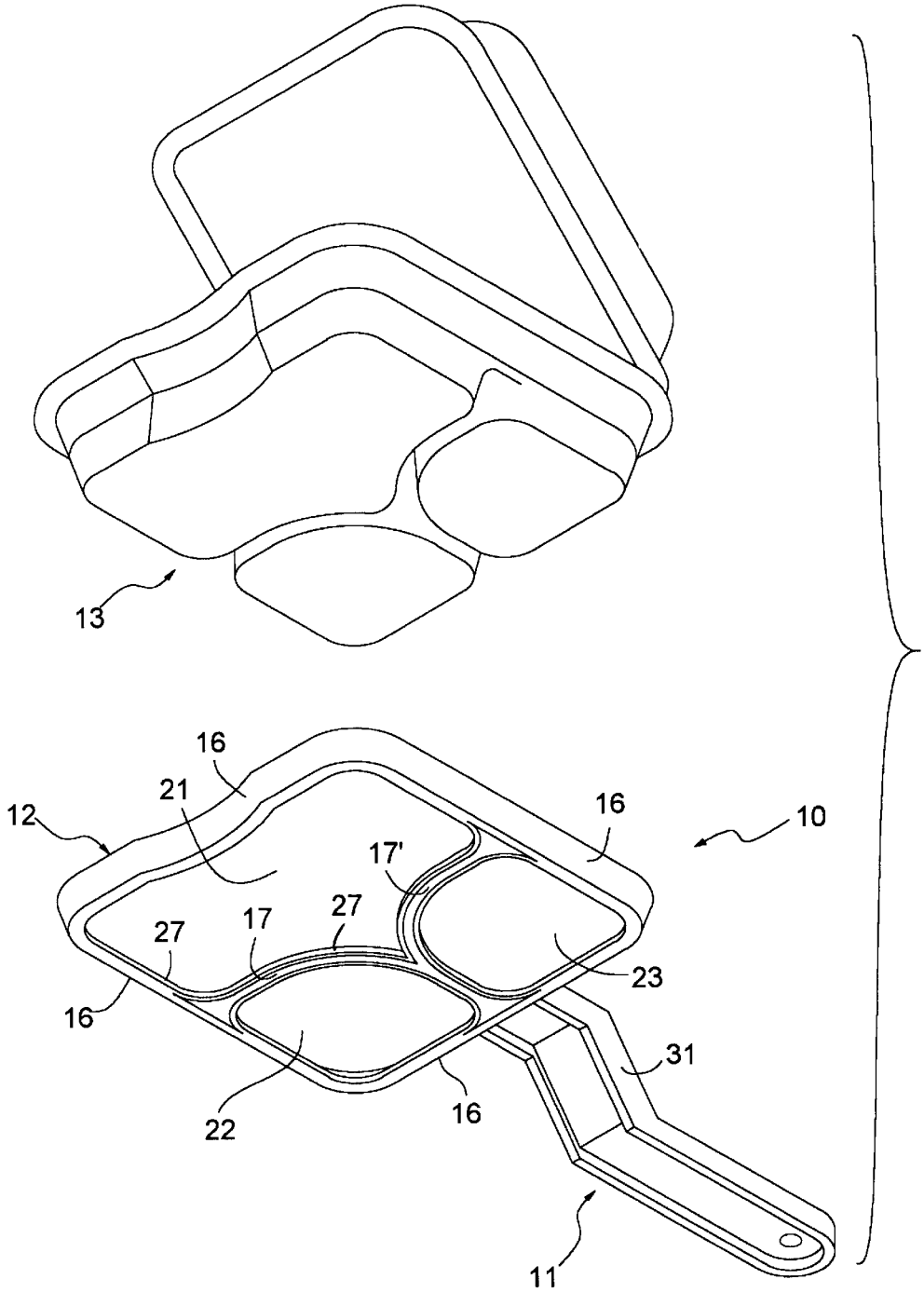
FIG. 4 is a bottom perspective view of the implement with a go box thereon.

Referring to the drawings for a clearer understanding of the invention, as may be seen in FIGS. 1–3, that my implement 10 utilizes a handle 11 which is appropriately shaped to allow a food service person to readily grasp it in one hand. Handle 11 is integrally formed with a web 12 which is designed for cooperative engagement with what is known in the industry as a go box 13 as shown in FIG. 4. As is well-known, go boxes come in a variety of sizes; however, most have at least three wells or pockets formed in them to receive and segregate foodstuffs. Go boxes are typically made from an expanded foam such that the wells and margins of the box have a uniform thickness, thus defining a set of channels intermediate the wells. Boxes are thus stackable for shipping and storage. Web 12 of my invention utilizes these channels as the structure which can be engaged to securely hold the box while filling it with food.

As may be seen in the drawings, web 12 includes a peripheral strip 16 which extends in conforming relation about all of the wells of the box forming a closed perimeter. Strip 16 will have the shape of the periphery of a go box and thus may be linear or curved as needed to ensure that strip 16 fits generally about the exterior of the bottom of the box. Integrally formed with strip 16 are one or more chordal strips 17 and 17'. These strips 17 and 17' extend inwardly from strip 16 and intersect one another as necessary to align with the channels formed intermediate the wells of the go box with which they are intended for use. It may be seen, therefore, that the exact size or configuration of the web 12 defined by strips 16, 17 and 17' will depend on the number of wells in the desired box and the size of the box. Accordingly, the three well box illustrated is intended only for illustration. As is well-known in the art, four well boxes and boxes with different well configurations are utilized; thus, web 12 may also be configured to accommodate such variations.

In the embodiment shown, strip 16 and 17 define a first large area opening 21, and strip 16, 17 and 17' combine to form two smaller area openings 22 and 23. Strips 16, 17, and 17' include surfaces 26 and 27 which face inwardly within these openings are inclined such that the openings taper from top to bottom. It is to be understood that the outer bottom surface of most go boxes is also inclined; thus, the surfaces 26 and 27 are cooperatively inclined such that the bottom surface of the go box wells is easily received within openings 21, 22, and 23 with surfaces 26 and 27 generally parallel to the surface of the box. In this manner the box can be received in a fully supported manner without any edge of the strips deforming the soft foam of the box and wedging the box in the web.

Handle 11 extends outwardly from between openings 22 and 23, or more particularly, from the margin of the web corresponding to the side on which the box opens. Most go boxes are provided with an integral lid attached to the food receiving wells by a living hinge of material such that the box and lid are stored in an open position and the box can be filled with the lid open. Handle 11 is intended to extend beneath the open lid and therefore, includes an offset portion 31 which extends downwardly from near peripheral strip 16 to adjoin with handle extension 11*a*. Offset 31 is spaced from strip 16 sufficiently to allow the lid of the go box to lay back out of the way to facilitate filling the wells. The food server may thus grasp the handle beneath the lid with the grasping hand completely shielded from the food stuff to avoid contamination and to avoid dripping hot foodstuff on the server.

It will be appreciated that the implement 10 may be made from metal, such that it is readily cleaned in commercial dishwashers or in an autoclave for highly sensitive areas. Likewise the implement may be molded from a durable plastic selected from any of a number of resins which are capable of yielding a rigid durable handle and web, including but not limited to such resins as ABS, PET, PVC. Likewise, certain high strength ceramic matrix materials could be used for the implement. In each case, however, it is important that the implement be capable of thorough cleansing or be expendable such that if it is not cleaned, it may be cheaply and easily disposed of.

The forgoing description is intended by way of illustration rather than limitation, with the full scope of my invention being comprehended within the bounds of the appended claims.

What I claim is:

1. A device for the sanitary handling of food comprising in combination, a) a go box container comprised of expanded foam, said container having an inner surface forming at least three wells for receiving and segregating food, an outer surface forming channels intermediate said wells, and a lid flexibly attached along a margin of said wells for selective closure thereof, and b) a reusable go box holding implement having a web in cooperative engagement with said outer surface of said container, said web comprising a peripheral strip forming a single closed perimeter and extending in conforming relationship with said outside surface of said container to substantially enclose all of said wells, said web further comprising at least two intersecting chordal strips integrally formed with said peripheral strip and extending inwardly therefrom in conforming relationship with said outside surface along said channels intermediate said wells, said holding implement further comprising a handle integrally formed with said web and extending outwardly from a margin of said peripheral strip corresponding to said margin of said container attached to said lid.

2. A device for the sanitary handling of food as described in claim 1 wherein said web is substantially horizontal and said handle has a substantially horizontal extension portion positioned below said web and an offset portion extending downwardly from said web to said extension portion so that said lid may be opened to overlie at least a portion of said extension portion of said handle.

3. A device for the sanitary handling of food as described in claim 2 wherein said go box container is comprises of flexible light weight foam.

4. A device for the sanitary handling of food as described in claim 2 wherein said go box container is stackable for shipping and storage.

5. A device for the sanitary handling of food as described in claim 4, wherein said lid is flexibly attached to said margin by a living hinge such that said container can be stored and filled with said lid in an open position.

6. A device for the sanitary handling of food as described in claim 2 wherein said holding implement is comprised of a material that is readily cleaned in commercial dishwashers.

7. A device for the sanitary handling of food as described in claim 6 wherein said holding implement is comprised of metal.

8. A device for the sanitary handling of food as described in claim 6 wherein said holding implement is comprised of a durable plastic.

9. A device for the sanitary handling of food as described in claim 6 wherein said holding implement is comprised of a high strength ceramic matrix material.

10. A device for the sanitary handling of food as described in claim 2 wherein said peripheral strip and said chordal strips are shaped to fit generally about the outside surface of said container.

11. A device for the sanitary handling of food as described in claim 10 wherein said outside surface is inclined and said peripheral strip and said choral strip have cooperatively inclined shapes such that said outside surface of said container is easily received by said web.

* * * * *